United States Patent [19]

Janusonis et al.

[11] Patent Number: 4,835,093

[45] Date of Patent: May 30, 1989

[54] INTERNALLY DOPED SILVER HALIDE EMULSIONS

[75] Inventors: Gaile A. Janusonis, Rochester; Ralph W. Jones, Hilton; James R. Buntaine, Rochester; Myra T. Olm, Webster; Raymond S. Eachus, Rochester, all of N.Y.

[73] Assignee: Eastman Kodak Company, Rochester, N.Y.

[21] Appl. No.: 179,380

[22] Filed: Apr. 8, 1988

[51] Int. Cl.[4] ..... G03C 1/08

[52] U.S. Cl. ..... 430/567; 430/569; 430/596; 430/604; 430/605; 430/606; 430/612

[58] Field of Search ..... 430/604, 605, 606, 612, 430/567, 569, 596

[56] References Cited

U.S. PATENT DOCUMENTS

| | | | |
|---|---|---|---|
| 2,448,060 | 8/1948 | Trivelli et al. | 430/603 |
| 2,458,442 | 1/1949 | Stauffer et al. | 430/608 |
| 2,950,972 | 8/1960 | Mueller et al. | 430/604 |
| 3,287,136 | 11/1966 | McBride | 430/569 |
| 3,790,390 | 2/1974 | Shiba et al. | 430/567 |
| 3,890,154 | 6/1975 | Ohkubo et al. | 430/434 |
| 3,901,711 | 8/1975 | Iwaosa et al. | 430/608 |
| 4,147,542 | 4/1979 | Habu et al. | 430/346 |
| 4,269,927 | 5/1981 | Atwell | 430/217 |

FOREIGN PATENT DOCUMENTS 242190 10/1987 European Pat. Off. .

OTHER PUBLICATIONS

B. H. Carroll, "Iridum Sensitization: A Literature Review", Photographic Science and Engineering, vol. 24, No. 6, Nov./Dec. 1980, pp. 265 267.

*Research Disclosure*, vol. 176, Dec. 1978, Item 17643.

D. M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20–26, 1978.

*Primary Examiner*—Richard L. Schilling
*Assistant Examiner*—Janet C. Baxter
*Attorney, Agent, or Firm*—Carl O. Thomas

[57] ABSTRACT

A photographic silver halide emulsion is disclosed comprised of radiation sensitive silver halide grains exhibiting a face centered cubic crystal lattice structure and internally containing rhenium ions.

16 Claims, 1 Drawing Sheet

INTERNALLY DOPED SILVER HALIDE EMULSIONS

FIELD OF THE INVENTION

The invention relates to photography. More specifically, the invention relates to photographic silver halide emulsions and to photographic elements containing these emulsions.

DEFINITION OF TERMS

All references to periods and groups within the periodic table of elements are based on the format of the periodic table adopted by the American Chemical Society and published in the *Chemical and Engineering* News, Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

The term "dopant" refers to a material other than a silver or halide ion contained within a silver halide grain.

The term "$pK_{sp}$" indicates the negative logarithm of the solubility product constant of a compound.

Grain sizes, unless otherwise indicated, are mean effective circular diameters of the grains, where the effective circular diameter is the diameter of a circle having an area equal to the projected area of the grain.

PRIOR ART

Trivelli and Smith U.S. Pat. No. 2,448,060, issued Aug. 31, 1948, taught that silver halide emulsions can be sensitized by adding to the emulsion at any stage of preparation—i.e., before or during precipitation of the silver halide grains, before or during the first digestion (physical ripening), before or during the second digestion (chemical ripening), or just before coating, a compound identified by the general formula:

$$R_2MX_6$$

wherein

R represents a hydrogen, an alkali metal, or an ammonium radical,

M represents a group 8 to 10 element having an atomic weight greater than 100, and X represents a halogen atom—e.g., chlorine or bromine.

With further investigation the art has recognized a distinct difference in the photographic effect of metal compounds in silver halide emulsions, depending upon whether the compound is introduced into the emulsion during precipitation of silver halide grains or subsequently in the emulsion making process. In the former instance it has been generally accepted that the metal can enter the silver halide grain as a dopant and therefore be effective to modify photographic properties, though present in very small concentrations. When metal compounds are introduced into an emulsion after silver halide grain precipitation is complete, they can be absorbed to the grain surfaces, but are sometimes largely precluded from grain contact by peptizer interactions. Orders of magnitude higher concentrations of metals are required to show threshold photographic effects when added following silver halide grain formation as compared to being incorporated in silver halide grains as dopants. The art distinction between metal doping, resulting from metal compound addition during silver halide grain formation, and metal sensitizers, resulting from metal compound addition to an emulsion folowing silver halide grain formation, is illustrated by Research Disclosure, Vol. 176, December 1978, Item 17643, wherein Section IA, dealing with metals introduced during grain precipitation, and Section IIIA, dealing with metal sensitizers introduced during chemical sensitization, provide entirely different lists of prior art teachings relevant to each practice. *Research Disclosure* is published by Kenneth Mason Publications, Ltd., Emsworth, Hampshire P010 7DD, England.

The metals most commonly incorporated into silver halide grains are the group 8 to 10 elements having an atomic weight greater than 100. The most common dopant of these is iridium, which is known to give a variety of useful photographic effects. B.H. Carroll, "Iridum Sensitization: A Literature Review", Photographic Science and Engineering, Vol. 24, No. 6, Nov./Dec. 1980, pp. 265–267, is cited for further background on conventional photographic uses of iridium.

Rodium introduced in the form of a rhodium hexachloride or hexabromide has also been extensively investigated. Greskowiak published European Patent Application No. 0,242,190/A2 discloses reductions in high intensity reciprocity failure in silver halide emulsions formed in the presence of one or more complex compounds of rhodium (III) having 3, 4, 5, or 6 cyanide ligands attached to each rhodium ion.

Ruthenium and osium has been investigated, but to a lesser extent. Although platinum and palladium dopants have been investigated and are known to be effective, these elements have not been attractive, since they are known to form complexes with gelatin, hindering their incorporation into silver halide grains grown in the presence of this common peptizer.

Other metal dopants are known. Zinc, cadmium, mercury, and lead dopants have been used to obtain various photographic effects, as illustrated by McBride U.S. Pat. No. 3,287,136, Mueller et al U.S. Pat. No. 2,950,972, Iwaosa et al U.S. Pat. No. 3,901,711, and Atwell U.S. Pat. No. 4,269,927.

Shiba et al U.S. Pat. No. 3,790,390, Ohkubo et al U.S. Pat. No. 3,890,154, and Habu et al U.S. Pat. No. 4,147,542 disclose silver halide grains doped with iron, cobalt, and nickel.

D.M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20–26, 1978, reported investigations of chloride iridium, rhodium, and gold complexes and, in addition, an emulsion prepared by introducing $(NH_4)_6Mo_7O_{24}(4H_2O)$.

Stauffer et al U.S. Pat. No. 2,458,442 discloses the incorporation of rhenium compounds in silver halide emulsions before coating, preferably after final digestion of the emulsion. The rhenium compounds are disclosed to act as fog inhibitors.

RELATED PATENT APPLICATIONS

McDugle et al U.S. Ser. No. 179,376, filed concurrently herewith and commonly assigned, titled PHOTOGRAPHIC EMULSIONS CONTAINING INTERNALLY MODIFIED SILVER HALIDE GRAINS, discloses silver halide emulsions comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements.

Keevert et al U.S. Ser. No. 179,377, filed concurrently herewith and commonly assigned, titled PHOTOGRAPHIC EMULSIONS CONTAINING INTERNALLY MODIFIED SILVER HALIDE GRAINS, discloses emulsions comprised of radiation sensitive silver halide grains containing greater than 50 mole percent chloride and less than 5 mole percent chloride, any residual halide being bromide. The grains exhibit a face centered cubic crystal lattice structure and are formed in the presence of a hexacoordination complex of rhenium, ruthenium, or osmium with at least four cyanide ligands. The emulsion exhibits increased sensitivity.

Marchetti et al U.S. Ser. No. 179,378, filed concurrently herewith and commonly assigned, titled PHOTOGRAPHIC EMULSIONS CONTAINING INTERNALLY MODIFIED SILVER HALIDE GRAINS, discloses emulsions comprised of radiation sensitive silver bromide and bromoiodide grains. The grains exhibit a face centered cubic crystal lattice structure and are formed in the presence of a hexacoordination complex of rhenium, ruthenium, or osmium with at least four cyanide ligands. The emulsions exhibit increased stability, both in terms of observed speed and minimum density, and reductions in reciprocity failure when exposure times are extended beyond 0.01 second.

SUMMARY OF THE INVENTION

In one aspect of this invention is directed to a photographic silver halide emulsion comprised of radiation sensitive silver halide grains exhibiting a face centered cubic crystal lattice structure internally containing rhenium ions.

It has been discovered that the photographic properties of silver halide emulsions can be improved for a variety of photographic applications by the incorporation of rhenium as a dopant in the silver halide grains.

Silver halide photography serves a wide spectrum of imaging needs. The amateur 35 mm photographer expects to capture images reliably over the full range of shutter speeds his or her camera offers, typically ranging from 1/10 of second or longer to 1/1000 of a second or less, under lighting conditions ranging from the most marginal twilight to mid-day beach and ski settings, which pictures being taken in a single day or over a period of months and developed immediately or months after taking, with the loaded camera often being left in an automobile in direct sun and stifling heat in the summer or overnight in mid-winter. These are stringent demands to place on the complex chemical systems which the film represents. Parameters such as speed, contrast, fog, pressure sensitivity, reciprocity failure, and latent image keeping are all important in achieving acceptable photographic performance.

While specialized and professional photography seldom places such diverse demands on a single film as the amateur photographer, even more stringent performance criteria are routinely encountered that must be invariantly satisfied. Action and motion study photography requires extremely high photographic speeds. High shutter speeds often require high intensity exposures. For such applications high intensity reciprocity failure must be avoided. Astronomical photography also requires high levels of photographic sensitivity, but exposure times can extend for hours to capture light from faint celestial objects. For such applications low intensity reciprocity failure is to be avoided. For medical radiography high photographic speeds are required and resistance to localized pressure modification of sensitivity (e.g., kink desensitization) is particularly important in larger formats, ranging from low to moderately high, to obtain the desired viewer response. Graphic arts photography requires extremely high levels of contrast. In some instances speed reduction (partial desensitization) is desired to permit handling of the film under less visually fatiguing lighting conditions (e.g., room light and/or green or yellow light) than customary red safe lighting. Color photography requires careful matching of the blue, green, and red photographic records, over the entire useful life of a film. While most silver halide photographic materials produce negative images, positive images are required for many applications. Both direct positive imaging and positive imaging of negative-working photographic materials by reversal processing serve significant photographic needs.

The present invention makes available to the art photographic emulsions which through rhenium doping of the grains exhibit improved photographic properties as compared to otherwise similar emulsions lacking rhenium doping. The exact nature of the photographic improvement obtained varies as a function of the halide content of the grains, the surface sensitization or fogging of the grains, the ligands next adjacent to rhenium in the silver halide grain structure, and the level of rhenium doping. Specific illustrations of photographic advantages are provided in the description below.

DESCRIPTION OF PREFERRED EMBODIMENTS

Figure 1:
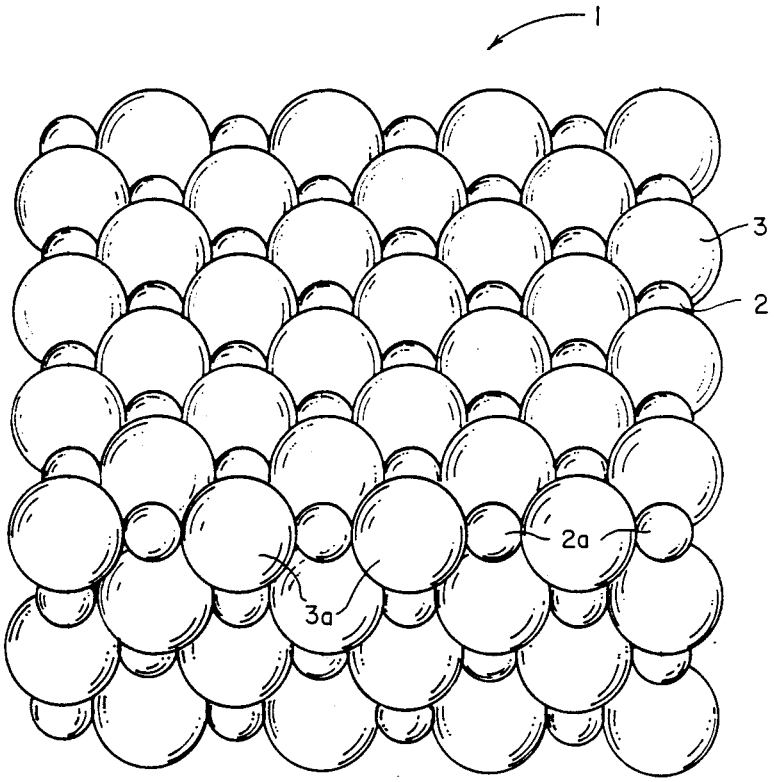
FIG. 1 is a schematic view of a silver bromide crystal structure with the upper layer of ions lying along a {100} crystallographic face.

Unlike silver iodide, which commonly forms only $\beta$ and $\gamma$ phases, each of silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of ions shown counting from the bottom of FIG. 1 lie in a {100} crystallographic plane which perpendicularly intersects the {100} crystallographic plane occupied by the upper layer of ions. The row containing silver ions **2*a* and bromide ions 3*a*** lies in both intersecting planes. In each of the two {100} crystallographic planes it can be seen that each silver ion and each bromide ion lies next adjacent to four bromide ions and four silver ions, respectively. In three dimensions then, each interior silver ions lies next adjacent to six bromide ions, four in the same {100} crystallographic plane and one on each side of the plane. A comparable relationship exists for each interior bromide ion.

The arrangement of ions in a silver chloride crystal is the same as that shown in FIG. 1, except that chloride ions are smaller than bromide ions. Silver halide grains in photographic emulsions can be formed of bromide ions as the sole halide, chloride ions as the sole halide, or any mixture of the two. It is also common practice to incorporate minor amounts of iodide ions in photographic silver halide grains. Since chlorine, bromine, and iodine are 3rd, 4th, and 5th period elements, respectively, the iodide ions are larger than the bromide ions. As much as 40 mole percent of the total halide in a silver bromide cubic crystal lattice structure can be accounted for by iodide ions before silver iodide separates as a separate phase. In photographic emulsions iodide concentrations in silver halide grains seldom exceeds 20 mole percent and is typically less than 10 mole percent, based on silver. However, specific applications differ widely in their use of iodide. Silver bromoiodide emulsions are employed in high speed (ASA 100 or greater) camera films, since the presence of iodide allows higher speeds to be realized at any given level of granularity. Silver bromide emulsions or silver bromoiodide emulsions containing less than 5 mole percent iodide are customarily employed for radiography. Emulsions employed for graphic arts and color paper typically contain greater than 50 mole percent, preferably greater than 70 mole percent, and optionally greater than 85 mole percent, chloride, but less than 5 mole percent, preferably less than 2 mole percent, iodide, any balance of the halide not accounted for by chloride or iodide being bromide.

The present invention is concerned with photographic silver halide emulsions in which rhenium has been internally introduced into the cubic crystal structure of the grain. Each rhenium can be viewed a direct replacement for one of the silver ions in the crystal lattice. When rhenium is introduced into a reaction vessel as a salt of the same halide employed to form the silver halide grains, the exact mechanism by which the rhenium finds itself in the crystal lattice structure is immaterial to the end result.

Rhenium, being a group 7 transition metal, is most commonly prepared in the form of a hexacoordination complex—that is, a complex anion containing rhenium and six ligands, usually halide ligands. It has been discovered that the choice of ligands associated with the rhenium during grain precipitation exhibit a significant influence on photographic performance. It is therefore believed that not merely rhenium, but the rhenium hexacoordination complex enters the grain structure as a dopant during silver halide precipitation. The parameters of such an incorporated complex can be roughly appreciated by considering the characteristics of a single silver ion and six adjacent halide ions (hereinafter collectively referred to as the seven vacancy ions) that must be omitted from the crystal structure to accommodate spatially a hexacoordinated rhenium complex. It is believed that the hexacoordination complex consisting of rhenium and its six bridging ligands takes the place of the seven vacancy ions. This is an important departure from the common view that transition metals are incorporated into silver halide grains as bare ions.

Referring to FIG. 1, it should be further noted that the silver ions are much smaller than the bromide ions, through silver lies in the 5th period while bromine lies in the 4th period. Further, the lattice is known to accommodate iodide ions, which are still larger than bromide ions. This suggests that the size of rhenium should not provide any barrier to its incorporation. A final observation that can be drawn from the seven vacancy ions is that the six halide ions exhibit an ionic attraction not only to the single silver ion that form the center of the vacancy ion group, but are also attracted to other adjacent silver ions.

The present invention employs within silver halide grains rhenium together with six adjacent halide or alternative ligands that can be viewed as completing an incorporated rhenium hexacoordination complex. To appreciate that a rhenium coordination complex having ligands other than halide ligands can be accommodated into silver halide cubic crystal lattice structure it is necessary to consider that the attraction between rhenium and its ligands is not ionic, but the result of covalent bonding, the latter being much stronger than the former. Since the size of a hexacoordination complex is determined not only by the size of the atoms forming the complex, but also by the strength of the bonds between the atoms, a coordination complex can be spatially accommodated into a silver halide crystal structure in the space that would otherwise be occupied by the vacancy ions, even though the number and/or diameters of the individual atoms forming the complex exceeds that of the vacancy ions. This is because the covalent bond strength can significantly reduce bond distances and therefore the size of the entire complex. It is a specific recognition of this invention that multi-element ligands of rhenium coordination complexes can be spatially accommodated to single halide ion vacancies within the crystal structure.

While spatial compatibility is impotant in choosing suitable rhenium coordination complexes, another factor which must be taken into account is the compatibility of the complex with the next adjacent ions in the crystal lattice structure. It is the recognition of this invention that compatibility can be realized by choosing bridging ligands for the rhenium complex. Looking at a single row of silver and halide ions in a cubic crystal lattice structure, the following relationship can be observed:

$$Ag^+X^-Ag^+X^-Ag^+X^-Ag^+X^-, \text{ etc.}$$

Notice that the halide ions X are attracting both adjacent silver ions in the row. When the portion of a rhenium coordination complex lying in a single row of silver and halide ions in a crystal structure is considered, the following relationship can be observed:

$$Ag^+X^-Ag^+—L—Re—L—Ag^+X^-, \text{ etc.}$$

where L represents a bridging ligand. While only one row of silver and halide ions is shown, it is appreciated that the complex forms part of three identical perpendicular rows of silver and halide ions having the rhenium as their point of intersection. Tetracoordination rhenium complexes place ligands in each of two intersecting rows lying in a common plane while rhenium hexacoordination complexes place ligands in each of three identical intersecting rows of ions.

Bridging ligands are those which can serve as bridging groups between two or more metal centers. Bridging ligands can be either monodentate or ambidentate. A monodentate bridging ligand has only one ligand atoms that forms two (or more) bonds to two (or more) different metal atoms. For monoatomic ligands, such as halides, and for ligands containing only one possible donor atom, the mondentate form of bridging is the only possible one. Multielement ligands with more than one donor atom can also function in a bridging capacity and are referred to as ambidentate ligands.

Rhenium hexacoordination complexes contemplated for incorporation in silver halide grains can be broadly represented by the formula:

$$[ReL_6]^k \quad (I)$$

where

L represents bridging ligands, which can be the same or different in each occurrence, and k is the integer zero, −1, −2, −3, or −4.

In the simplest form of the invention the rhenium ligands are halide ligands—i.e., monoatomic monodentate bridging ligands. The halide forming the ligands can be the same or a different halide to that forming the remainder of the grain structure, Fluoride, chloride, bromide, and iodide ligands are all contemplated, although chloride and bromide ligands are generally preferred. Up to two halide ligands can be replaced in a rhenium hexacoordination complex with aquo ligands ($H_2O$) ligands.

It has been disovered by McDugle et al, cited above, that nitrosyl and thionitrosyl ligands can be incorporated into silver halide grains as part of a transition metal coordination complex. Nitrosyl ligands are generally recognized to be monodentate bridging ligands exhibiting the structure

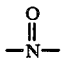

On the other hand, thionitrosyl (—NS) ligands cannot be categorized with certainty as being strictly monodentate or strictly ambidentate bridging ligands. While bonding to the transition metal is through the nitrogen atom, it would be reasonable to expect attraction of a neighboring silver ion through either of the nitrogen or sulfur atom.

Preferred rhenium nitrosyl and thionitrosyl coordination complexes can be represented by the formula:

$$[ReL4(NY)L']^m \quad (II)$$

where

L is a bridging other than nitrosyl or thionitrosyl ligand, preferably a halide ligand;

L' is L or (NY);

Y is oxygen or sulfur; and m is zero, −1, −2, or −3.

Halide ligands can be selected from those described above and up to two of the halide ligands can be replaced by aquo ligands.

Cyanide ligands can replace from 1 to 6 of the halide ligands in the rhenium incorporated coordination complexes. In a preferred form, discovered by Keevert et al and Marchetti et al, cited above, incorporated rhenium coordination complexes can satisfy the formula:

$$[Re(CN)_{6-y}L_y]^n \quad (III)$$

where

L is a bridging ligand other than a cyanide, nitrosyl, or thinitrosyl ligand, preferably a halide or aquo ligand;

y is the integer zero, 1, or 2; and n is −2, '3, or −4.

Other ligands are possible. Specific examples of preferred bridging ligands other than those noted above are cyanate ligands, thiocyanate ligands, selenocyanate ligands, tellurocyanate ligands, and azide ligands. Still other bridging ligand choices are possible.

The rhenium coordination complexes comtemplated for grain incorporation in most instances exhibit a net ionic charge. One or more counter ions are therefore usually associated with the complex to form a charge neutral compound. The counter ion is of little importance, since the complex and its counter ion or ions dissociate upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

Table I provides a listing of illustrative compounds of hexacoordinated transition metal complexes satisfying the requirements of the invention:

TABLE I

| | |
|---|---|
| TMC-1 | $[ReCl_6]^{-2}$ |
| TMC-2 | $[ReBr_6]^{-2}$ |
| TMC-3 | $[ReI_6]^{-2}$ |
| TMC-4 | $[Re(NO)Cl_5]^{-2}$ |
| TMC-5 | $[Re(NO)Br_5]^{-2}$ |
| TMC-6 | $[Re(NS)Cl_5]^{-2}$ |
| TMC-7 | $[Re(NS)Br_5]^{-2}$ |
| TMC-8 | $[Re(NO)Cl_2(CN)_3]^{-2}$ |
| TMC-9 | $[Re(NO)(CN)_5]^{-3}$ |
| TMC-10 | $[Re(CN)_6]^{-4}$ |
| TMC-11 | $[ReF(CN)_5]^{-4}$ |
| TMC-12 | $[ReCl(CN)_5]^{-4}$ |
| TMC-13 | $[RuCl(CN)_5]^{-4}$ |
| TMC-14 | $[ReBr(CN)_5]^{-4}$ |
| TMC-15 | $[ReI(CN)_5]^{-4}$ |
| TMC-16 | $[ReF_2(CN)_4]^{-4}$ |
| TMC-17 | $[ReCl_2(CN)_4]^{-4}$ |
| TMC-18 | $[ReBr_2(CN)_4]^{-4}$ |
| TMC-19 | $[ReCl_5(H_2O)]^{-1}$ |
| TMC-20 | $[ReBr_5(H_2O)]^{-1}$ |
| TMC-21 | $[ReCl_5(SCN)]^{-2}$ |
| TMC-22 | $[ReBr_5(SCN)]^{-2}$ |
| TMC-24 | $[Re(CN)_5(N_3)]^{-4}$ |

Rhenium can be incorporated into silver halide gains beginning with simple salts or coordination complexes, such as those disclosed in Table I, by procedures, similar to those employed in incorporating other metal dopants in silver halide grains. Such teachings are illustrated by Wark U.S. Pat. No. 2,717,833; Berriman U.S. Pat. No. 3,367,778; Burt U.S. Pat. No. 3,445,235; Bacon et al U.S. Pat. No. 3,446,927; Colt U.S. Pat. No. 3,481,122; Bacon U.S. Pat. No. 3,531,291; Bacon U.S. Pat. No. 3,574,625; Japanese Patent (Kokoko) No. 33781/74 (priority May 10, 1968); Japanese Patent (Kokoku) No. 30483/73 (priority Nov. 2, 1968); Ohkubo et al U.S. Pat. No. 3,890,154; Spence et al U.S. Pats. Nos. 3,687,676 and 3,690,891; Gilman et al U.S. Pat. No. 3,979,213; Motter U.S. Pat. No. 3,703,584; Japanese Patent (Kokoku) No. 32738/70 (priority Oct. 22, 1970); Shiba et al U.S. Pat. No. 3,790,390; Yamasue et al U.S. Pat. No. 3,901,713; Nishina et al U.S. Pat. No. 3,847,621; Research Disclosure, Vol. 108, Apr. 1973, Item 10801; Sakai U.S. Pat. No. 4,126,472; Dostes et al Defensive Publication T962,004 and French Pat. No. 2,296,204; U.K. Specification No. 1,527,435 (priority Mar. 17, 1975); Japanese Patent Publication (Kokai) No. 107,129/76 (priority Mar. 18, 1975); Habu et al U.S. Pats. Nos. 4,147,542 and 4,173,483; Research Disclosure, Vol. 134, June 1975, Item 13452; Japanese Patent Publication (Kokai) No. 65,432/77 (priority Nov. 26, 1975); Japanese Patent Publication (Kokai) No.

76,923/77 (priority Dec. 23, 1975); Japanese Patent Publication (Kokai) No. 88,340/77 (priority Jan. 26, 1976); Japanese Patent Publication (Kokai) No. 75,921/78 (priority Dec. 17, 1976); Okutsu et al U.S. Pat. No. 4,221,857; Japanese Patent Publication (Kokai) No. 96,024/79 (priority Jan. 11, 1978); Research Disclosure, Vol. 181, May 1979, Item 18155; Kanisawa et al U.S. Pat. No. 4,288,533; Japanese Patent Publication (Kokai) No. 25,727/81 (priority Aug. 7, 1979); Japanese Patent Publication (Kokai) No. 51,733/81 (priority Oct. 2, 1979); Japanese Patent Publication (Kokai) No. 166,637/80 (priority Dec. 6, 1979); and Japanese Patent Publication (Kokai) No. 149,142/81 (priority Apr. 18, 1970); the disclosures of which are here incorporated by reference.

When silver halide grains are formed a soluble silver salt, usually silver nitrate, and one or more soluble halide salts, usually an ammonium or alkali metal halide salt, are brought together in an aqueous medium. Precipitation of silver halide is driven by the high $pK_{sp}$ of silver halides, ranging from 9.75 for silver chloride to 16.09 for silver iodide at room temperature. For a transition metal complex to coprecipitate with silver halide it must also form a high $pK_{sp}$ compound. If the $pK_{sp}$ is too low, precipitation may not occur. On the other hand, if the $pK_{sp}$ is too high, the compound may precipitate as a separate phase. Optimum $pK_{sp}$ values for silver counter ion compounds of rhenium complexes should be in or near the range of $pK_{sp}$ values for photographic silver halides—that is, in the range of from about 8 to 20, preferably about 9 to 17.

Rhenium dopants satisfying the requirements of the invention can be incorporated in silver halide grains in the same concentrations, expressed in moles per mole of silver, as have been conventionally employed for transition metal doping. An extremely wide range of concentrations has been taught, ranging from as low as $10^{-10}$ mole/Ag mole taught by Dostes et al, cited above, for reducing low intensity reciprocity failure and kink desensitization in negative-working emulsions, to concentrations as high as $10^{-3}$ mole/Ag mole, taught by Spencer et al, cited above, for avoidance of dye desensitization. Useful concentrations can vary widely, depending upon the halide content of the grains, the ligands present in the dopant, and the photographic effect sought.

Apart from the incorporated rhenium dopant satisfying the requirements of the invention, the silver halide grains, the emulsions of which they form a part, and the photographic elements in which they are incorporated can take any of a wide variety of conventional forms. A survey of these conventional features as well as a listing of the patents and publications particularly relevant to each teaching is provided by *Research Disclosure,* Item 17643, cited above, the disclosure of which is here incorporated by reference. It is specifically contemplated to incorporate transition metal coordination complexes satisfying the requirements of this invention in tabular grain emulsions, particularly thin (less than 0.2 μm) and/or high aspect ratio (>8:1) tabular grain emulsions, such as those disclosed in Wilgus et al U.S. Pat. No. 4,434,226; Kofron et al U.S. Pat. No. 4,439,520; Daubendiek et al U.S. Pats. Nos. 4,414,310, 4,693,964 and 4,672,027; Abbott et al U.S. Pat. No. 4,425,425 and 4,425,426; Wey U.S. Pat. No. 4,399,2153; Solberg et al U.S. Pat. No. 4,433,048; Dickerson U.S. Pat. No. 4,414,304; Mignot U.S. Pat. No. 4,386,156; Jones et al U.S. Pat. No. 4,478,929; Evans et al U.S. Pat. No. 4,504,570; Maskasky U.S. Pats. Nos. 4,400,463, 4,435,501, 4,643,966, 4,684,607, 4,713,320, and 4,713,323; Wey et al U.S. Pat. No. 4,414,306; and Sowinski et al U.S. Pat. No. 4,656,122; the disclosures of which are here incorporated by reference.

The following are specific illustrations of how incorporated hexcoordinated transition metal complexes satisfying the requirements of this invention can be employed for achieving specific photographic improvements:

A. Fogged Direct Positive Emulsions

It is specifically contemplated to incorporate in the grains of prefogged direct positive emulsions or direct positive photobleach emulsions (described as a class in James, *The Theory of the Photographic Process,* Macmillan, 4th Ed., 1977, pp. 185 and 186) rhenium as a bare cation or in the form of any of the complexes satisfying Formula I. Useful concentrations range from as little as $10^{-8}$ mole per silver mole up to the solubility limit of the rhenium, typically about $10^{-3}$ mole per silver mole. Typical concentrations contemplated are in the range of from about $10^{-6}$ to $10^{-4}$ mole per silver mole.

In one specific preferred form of the invention the direct positive emulsion contains suface fogged silver chloride grains or silver bromide grains optionally containing up to about 3 mole percent iodide doped with from about $10^{-5}$ to $10^{-4}$ mole per silver mole of rhenium. Rhenium is preferably incorporated in the form of a complex satisfying Formula I, wherein L represents chloride or bromide ligands only or in combination with up to two aquo ligands.

In another preferred form, rhenium is incorporated in the form of a complex satisfying Formula II. The general concentration ranges noted above are applicable.

Photobleach emulsions of the type contemplated employ surface fogged silver halide grains. Exposure results in photogenerated holes bleaching the surface fog. Increased sensitivity of the emulsions of rhenium incorporation is indicative that rhenium along or in combination with its ligands is internally trapping electrons. This avoids recombination of photogenerated hole-electron pairs which reduce the population of holes available for surface bleaching of fog.

As is well understood in the art, substantial advantages in speed sensitometry are realized by employing a combination of reduction and gold sensitizers to generate surface fog. Examples of emulsions of this type are those containing grains internally incorporating complexes as described above and otherwise conforming to the teachings of Berriman U.S. Pat. No. 3,367,778 and Illingsworth U.S. Pats. Nos. 3,501,305, 3,501,306, and 3,501,307, here incorporated by reference.

B. Speed Reduction in Negative Working Emulsions

In some photographic applications it is desirable to reduce speed to permit handling of the photographic materials under more visually favorable working conditions (e.g., handling in room light and/or in green or yellow light).

Another need for speed reduction has arisen recently in attempting to form full tone photographic images by laser scanning. Commercially available lasers have been observed to exhibit high intensity levels and limited output modulation capabilities, resulting in production of maximum densities in all laser exposed areas, as opposed to the desired graded image densities. While smaller mean grain size emulsions are a known route to reducing photographic speed, it is generally preferred to maintain mean grain sizes greater than about 0.3 μm to achieve preferred (shorter wavelength—e.g., blue-black) image tone and greater batch to batch reproducibility of emulsion properties. There are, of course, known densitizers that can be adsorbed to silver halide grain surfaces, but, being at the grain surface, adsorbed desensitizers can lead to a variety of replication and process control problems attributable to unwanted surface interactions. The ideal speed reducer is an internal dopant, since very limited quantities are required and results are obtained which are more reproducible over a wider range of conditions.

While any concentration of rhenium dopant can be employed which imparts an observable speed reduction, rhenium concentrations are generally contemplated in concentrations below $1\times10^{-4}$ mole per silver mole. Specific optimum rhenium concentrations are provided below, which vary as a function of the specific application.

B-1. Rhenium Hexahalide Complexes In High Chloride Emulsions

In one preferred form of the invention high chloride emulsions are doped with a rhenium hexahalide complex. High chloride emulsions contain greater than 50 mole percent (preferably greater than 70 mole percent and optimally greater than 85 mole percent) chloride. The emulsions contain less than 5 mole percent (preferably less than 2 mole percent) iodide, with the remainder of the halide, if any, being bromide. Silver chloride emulsions are the simplest example of high chloride emulsions.

Photographically useful speed reductions have been observed when the grains of high chloride silver halide emulsions contain from about $10^{-9}$ to $10^{-7}$ mole per silver mole of rhenium, added in the form of rhenium hexahalide. Preferred halide ligands are chloride and bromide ligands.

B-2. Rhenium Hexachloride Complexes In Silver Bromide and Bromoiodide Emulsions In another preferred form of the invention silver bromide emulsions optionally containing iodide have been observed to exhibit photographically useful speed reductions when doped with rhenium, added during precipitation in the form of a rhenium hexachloride complex. The emulsion can be a pure silver bromide emulsion. Iodide can be present in any conventional amount—e.g., from as little as 0.1 mole percent to 40 mole percent, based on silver. More typically iodide is present in concentrations of from 1 to 5 to 10 to 20 mole percent, depending upon the specific photographic application. For example, radiographic imaging usually employs no more than 5 mole percent iodide, black-and-white imaging typically employs less than 10 mole percent iodide, and color photography, which often relies on high iodide levels for interimage effects, often employs iodide levels of up to 20 mole percent.

Optimum speed reductions have been observed when the grains of silver bromide and bromoiodide emulsions contain from about $10^{-8}$ to $10^{-7}$ mole per silver mole of rhenium, added in the form of rhenium hexachloride.

B-3. Rhenium Hexabromide Complexes In Silver Bromide and Bromoiodide Emulsions When the rhenium hexabromide complex is substituted for rhenium hexachloride in the emulsions of preceding paragraph B-2, photographically useful optimum reductions in photographic speed are realized with concentrations of dopant of about $10^{-7}$ to $10^{-5}$ mole per silver mole. Optimum speed reductions are observed in concentrations ranging from $10^{-7}$ to $10^{-6}$ mole of dopant per silver mole

B-4. Rhenium Nitrosyl and Thionitrosyl Complexes

When rhenium hexacoordination complexes containing one or more nitrosyl or thionitrosyl ligands are incorporated into a silver halide emulsion photographically useful speed reductions are produced. The effect does not appear to be dependent on the halide content of the emulsion. For example, useful speed reduction effects can be achieved in each of the high chloride, silver bromide, and silver bromoiodide emulsions discussed in the preceding paragraphs.

Preferred hexacoordinated complexes for this application are those satisfying Formula II. Specifically preferred concentrations are in the range of from $1\times10^{-9}$ to $5\times10^{-5}$ mole per silver mole.

C. Reduced Low Intensity Reciprocity Failure in Negative Working Emulsions

Photographic exposure is the product of exposure time and intensity. In some instances reduced exposure intensities, though compensated by extended exposure times to produce the same exposure level, result in lowered observed photographic speed. This is referred to as low intensity reciprocity failure.

It is an observation of this invention that the incorporation of a rhenium dopant can reduce low intensity reciprocity failure. Investigation suggests that the rhenium dopants described above for use in speed reduction disproportionately reduce high intensity photographic speeds, and in some instances the low intensity photographic speed actually increases slightly. Thus, the emulsions and rhenium dopants discussed above in connection with speed reduction are also applicable to reducing low intensity reciprocity failure. However, in practice, where reduction in low intensity reciprocity failure is being sought rather than significant overall speed reductions, the concentrations of the rhenium dopant are understandably limited.

C-1. Rhenium Hexabromide Complexes In Silver Bromide and Bromoiodide Emulsions In one preferred form of the invention reductions in low intensity recriprocity failure are achieved in silver bromide and silver bromoiodide emulsions when a rhenium hexabromide complex is incorporated in the grains in concentrations of about $10^{-7}$ to $10^{-5}$ mole per silver mole. Although reductions in low intensity reciprocity failure are observed in both cubic and octahedral grain emulsions, absolute as opposed to relative increases in low intensity speeds have been observed in cubic grain emulsions. The terms "cubic grain" and "octahedral grain" are employed in their art recognized sense as designating grains bounded predominantly by {100} and {111} crystallographic faces, respectively. Both types of grains exhibit a cubic crystal lattice structure.

C-2. Rhenium Nitrosyl and Thionitrosyl Complexes In High Chloride Emulsions

It has been observed that reduced low intensity reciprocity failure can be realized in high chloride emulsions which have been surface sensitized with gold and/or middle chalcogen (i.e., sulfur, selenium, and/or tellurium) and which contain an incorporated complex satisfying Formla II. Similar concentrations preferred for speed reduction, set forth in section B—4 above are also preferred for reducing low intensity reciprocity failure.

D. High Chloride Graphic Arts Emulsions

It has been observed when rhenium complexes satisfying Formula II are incorporated in high chloride emulsions useful for graphic arts improvements in the properties of these emulsions for this application are realized. For example, both increases in contrast and reduced susceptibility to room light, attributable to speed reduction, discussed above, are observed. For graphic arts applications the rhenium complex of Formula II is preferably incorporated in the grains in concentrations of from $2\times10^{-8}$ to $1\times10^{-4}$, optimally from $2\times10^{-8}$ to $3\times10^{-5}$ mole per mole. For graphic arts applications the emulsions are monodispersed and preferably have a mean grain size of less than 0.7 μm, optimally less than 0.4 μm.

E. Rhenium Cyanide Complexes Producing Increased Sensitivity in High Chloride Emulsions It has been surprisingly discovered that when rhenium cyanide complexes, such as those satisfying Formula III, are incorporated into sulfur and/or gold sensitized high chloride emulsions increased sensitivities can be realized, as compared to emulsions that are identically sensitized, but lack the incorporated rhenium cyanide complex. Concentrations of the rhenium complex in the grains ranging from $1\times10^{-6}$ to $5\times10^{-4}$ mole per silver mole are preferred. Concentrations of from $10^{-5}$ to $10^{-4}$ mole per silver being considered optimum.

F. Rhenium Cyanide Complexes Producing Increased Stability in Silver Bromide and Silver Bromoiodide Emulsions It has been discovered that rhenium cyanide complexes, such as those satisfying Formula III, can impart increased stability to silver bromide and silver bromoiodide emulsions. The improvement in stability can be observed both in terms of speed and minimum density levels. Concentrations of the rhenium complex in the grains ranging from $1\times10^{-6}$ to $5\times10^{-4}$ mole per silver mole are preferred. Concentrations of from $10^{-5}$ to $10^{-4}$ mole per silver being considered optimum.

All of the photographic effects noted above discussed by reference to rhenium as a bare ion dopant or as a complex satisfying Formula I are original observations of this invention. The photographic effects discussed above by refernce to Formluae II and III are the specific subject matter of the commonly assigned, concurrently filed patent applications, included here to demonstrate the breadth of the present invention.

EXAMPLES

The invention can be better appreciated by reference to the following specific examples:

EXAMPLE 1

Two monodisperse silver chloride emulsions were prepared in which the variation made was in the presence and absence of $Cs_2Re(NO)Cl_5$.

Control Emulsion IA was made in the absence of $Cs_2Re(NO)Cl_5$ according to the following directions:

Three solutions were prepared of the following compositions:

| | |
|---|---|
| Solution 1 | |
| Gelatin | 240 g |
| D.W. | 6000 mL |
| Solution 2 | |
| Sodium chloride | 584 g |
| D.W. to total volume | 5000 mL |
| Solution 3 | |
| Silver nitrate | 1360 g |
| D.W. | 2640 mL |
| Dissolved at 40° C. | |
| D.W. to total volume | 4000 mL |
| Dissolved at 40° C. | |

Solution 1 was placed in a reaction vessel maintained at 46° C. To Solution 1 was added 0.6 g of a thioether silver halide ripening agent of the type disclosed in McBride U.S. Pat. No. 3,271,157. The pAg of the solution was then adjusted to 7.6 with Solution 2. Solutions 2 and 3 were then simultaneously run into Solution 1 over a 15 minute period, maintaining the pAg at 7.6. Following the precipitation the gmixture was cooled to 38° C. and washed by ultrafiltration as described in *Research Disclosure,* Vol. 102, October 1972, Item 10208. At the end of the washing period, the emulsion concentration was adjusted to a weight below 2000 g per mole of silver containing 60 g of gelatin per mole of silver. The mean grain size was 0.26 μm.

Example Emulsion 1B was prepared similarly as Control Emulsion 1A, except that after 2 minutes of simultaneous running of Solutions 2 and 3, 2.3 mL of Solution 4 was injected through a syringe into the line delivering Solution 2 to the reaction vessel.

Solution 4 was prepared by dissolving $Cs_2Re(NO)Cl_5$ in a solution identical to Solution 2 in an amount sufficient to give $1.3\times10^{-7}$ mole $Cs_2Re(NO)Cl_5$ per final mole of silver in the reaction vessel and $4.7\times10^{-8}$ mole per final silver mole in the grains.

The silver chloride emulsions prepared as described above were given a conventional gold chemical sensitization and green spectral sensitization and coated with a dye-forming coupler dispersion on a photographic paper base at square meter coverage of 280 mg Ag, 430 mg coupler, and 1.66 g gelatin. The coated elements were then exposed through a graduated density step wedge at times ranging from 0.5 to 100 seconds, with suitable neutral density filters added to maintain constant total exposure. The coatings were processed in a color print developer.

Increased toe contrast and reduced low intensity contrast reciprocity failure were observed in the rhenium containing emulsion as compared to the control.

EXAMPLE 2

A series of silver bromide octahedral emulsions of 0.45 μm average edge length were prepared, differing in the hexacoordinated transition metal complex incorporated in the grains.

Control 2A was made with no transition metal complex present according to the following procedure:

Six solutions were prepared as follows:

| | |
|---|---|
| Solution 1(2) | |
| Gelatin (bone) | 50 gm |
| D.W. | 2000 mL |
| Solution 2(2) | |
| Sodium bromide | 10 gm |
| D.W. | 100 mL |

-continued

| | |
|---|---|
| Solution 3(2) | |
| Sodium bromide | 412 gm |
| D.W. to total volume | 1600 mL |
| Solution 4(2) | |
| Silver nitrate (5 Molar) | 800 mL |
| D.W. to total volume | 1600 mL |
| Solution 5(2) | |
| Gelatin (phthalated) | 50 gm |
| D.W. | 300 mL |
| Solution 6(2) | |
| Gelatin (bone) | 130 gm |
| D.W. | 400 mL |

Solution 1(2) was adjusted to a pH of 3.0 with nitric acid at 40° C. The temperature of solution 1(2) was adjusted to a 70° C. Solution 1(2) was then adjusted to a pAg of 8.2 with solution 2(2). Solutions 3(2) and 4(2) were simultaneously run into the adjusted solution 1(2) at a constant rate for the first 4 minutes with introduction being accelerated for the next 40 minutes. The addition rate was then maintained over a final 2 minute period for a total addition time of 46 minutes. The pAg was maintained at 8.2 over the entire run. After the addition of solutions 3(2) and 4(2), the temperature was adjusted to 40° C., the pH was adjusted to 4.5, and solutions 5(2) was added. The mixture was then held for 5 minutes, after which the pH was adjusted to 3.0 and the gel allowed to settle. At the same time the temperature was dropped to 15° C. before decanting the liquid layer. The depleted volume was restored with distilled water. The pH was readjusted to 4.5, and the mixture held at 40° C. for ½ hour before the pH was adjusted to 3.0 and the settling and decanting steps were repeated. Solution 6(2) was added, and the pH and pAg were adjusted to 5.6 and 8.2, respectively. The emulsion was digested with 1.5 mg per Ag mole of $Na_2S_2O_3.5H_2O$ and 2 mg per Ag mole $KAuCl_4$ for 40 minutes at 70° C. Coatings were made at 27 mg Ag/dm$^2$ and 86 mg gelatin/dm$^2$. The samples were exposed to 365 nm radiation for 0.01, 0.1, 1.0, and 10.0 seconds and developed for 6 minutes in a hydroquinone-Elon ®(N-methyl-p-aminophenol hemisulfate) developer.

Control 2A' was prepared identically to Control Emulsion 2A. This emulsion was included to indicate batch to batch variances in emulsion performance. Emulsion 2A' was digested in the same manner as Control 2A.

Examples 2B and 2C were prepared similarly as Control 16A, except that Solution 1(TMC) or 2(TMC) were added after the first four minute nucleation period and during the first 35 minutes of the growth period into the Solution 3(2). Some of Solution 3(2) was kept in reserve and was the source of transition metal complex free sodium bromide added during the last 7 minutes of the preparation. The emulsions were digested in the same ways as Emulsion 2A.

Solutions 1(TMC) and 2(TMC) were prepared by dissolving 0.26 and 66 mg, respectively, of $Cs_2Re(NO)Cl_5$ (see Table II) in that part of Solution 3(16) that was added during the 38 to 40 minute growth period of Control 2A. The incorporated transition metal complex functions as an effective electron trap, as demonstrated by the decreased surface speed shown in Table II.

TABLE II

| Ex/Cont | Transition Metal Complex Formula | Transition Metal Complex Micromole/Ag Mole | Relative Speed |
|---|---|---|---|
| 2A | — | — | 100 |
| 2A' | — | — | 100 |
| 2B | $Cs_2Re(NO)Cl_5$ | 0.1 | 70 |
| 2C | $Cs_2Re(NO)Cl_5$ | 1 | 22 |

EXAMPLE 3

This example illustrates the properties of an emulsion doped with a rhenium complex containing a nitrosyl ligand as compared to an undoped control.

The undoped 0.15 μm silver chloride control emulsion was precipitated in the following manner.

| | |
|---|---|
| Solution A (Reaction Vessel) | |
| Bone Gelatin | 40.0 g |
| D.W. | 666.0 ml |
| Temperature | 40.6° C. |
| pH ($H_2SO_4$) | 3.0 |
| Solution B (Salts) | |
| NaCl | 66.6 g |
| D.W. | 317.2 cc |
| Temperature | 40.6° C. |
| Solution C (Silver) | |
| $AgNO_3$ | 170.0 g |
| D.W. | 301.3 ml |
| Temperature | 30.8° C. |

D.W. = Distilled Water

Solutions B and C were added simultaneously at constant flow rate (B=20.3 ml/min, C=22.3 ml/min) to a well stirred reaction vessel containing Solution A. Total run time for Solutions B and C was 15 minutes. The emulsion precipitation was controlled at a pAg of 7.4. At the end of the precipitation, the emulsion was adjusted to a pH of 4.5 and was ultrafiltered at 40.6° C. for 30 to 40 minutes to a pAg of 6.2. The emulsion was chill set. Coatings were prepared containing 1.0 g of 4-hydroxy-6-methyl-1,3,3a, 7-tetraazaindene/mole Ag, and 5.0 g of bis(vinylsulfonyl)methane/mole Ag. The silver and gel coverages of the coatings were 3.3 g Ag/m$^2$ and 2.7 gel/m$^2$.

The rhenium nitrosyl complex doped example emulsion was also prepared and coated, as described above, differing only by addition of the dopant indicated below in Table III. Dopant was added 30 seconds after the start of the precipitation for 30 seconds from a water solution (1.0 mg dopant/ml D.W.). All coated samples were exposed using a metal halide light source and developed for 35 seconds in a hydroquinone-(4-hydroxymethyl-4-methyl-1-phenyl-3-pyrazolidone) developer, pH 10.4, at 35° C. using an LD-220 QT Dainippon TM screen processor.

The sensitometric results summarized in Table III show that the nitrosyl containing complex produced a highly desirable contrast increase and speed decrease as compared to the undoped control emulsion.

TABLE III

| Dopant | Concentration (mole dopant/mole Ag) | Contrast* | Relative UV Speed** |
|---|---|---|---|
| None | 0 | 3.3 | 328 |
| $Cs_2Re(NO)Cl_5$ | $5.00 \times 10^{-6}$ | 5.6 | 310 |

*Measured at 1.0 to 2.5 density above D-Min
**Measured at 0.1 density above D-Min.

EXAMPLE 4

This example illustrates the effectiveness of rhenium as a dopant to produce a reversal image image in a fogged direct positive emulsion.

CONTROL 4A

A 0.16 μm AgCl undoped control emulsion was prepared by a conventional double jet procedure. The emulsion was reduction fogged by finishing for 60 minutes at 65° C. with 10 mg of thiourea dioxide per silver mole.

The emulsion was coated on a film support at a coating density of 4.16 g/m$^2$ silver and exposed through a graduated density test object to ultraviolet radiation from a Berkey ASCOR TM vacuum printer for 15 seconds. The coated emulsion was then developed in a 10.5 pH hydroquinone-4-phenyl-4,4-dimethyl-3-pyrazolidone developer for 15 seconds at 43° C.

No image was observed. A density of greater than 3.8 was observed at all exposure levels. This indicated that photogenerated hole-electron pairs were recombining without appreciable bleaching of surface fog. In other words, the grains lacked an effective internal electron trap.

EXAMPLE 4B

A 0.16 μm AgCl control emulsion was prepared by a conventional double jet procedure, but modified by the incorporation of $1\times10^{-5}$ mole of $K_2ReCl_6$ to the reaction vessel per final mole of silver. The rhenium complex was added to the reaction vessel at 20 percent into the run.

The emulsion was reduction fogged by finishing for 60 minutes at 65° C. with 2.6 mg of thiourea dioxide per silver mole.

The emulsion was coated on a film support at a coating density of 4.16 g/m$^2$ silver. Separate samples of the coated emulsion were exposed through a graduated density test object to 365 nm line exposure for 20 to 60 seconds. The samples were then developed in a 10.15 pH hydroquinone low sulfite lith developer for 165 seconds at 20° C.

A reversal image was obtained exhibiting a maximum density of 3.2 and a minimum density of 0.9. This indicated that the incorporated rhenium was internally trapping photogenerated electrons, thereby reducing recombination of photogenerated hole-electron pairs and allowing the photogenerated holes to bleach surface fog.

EXAMPLE 4C

Example 4B was repeated through the step of emulsion precipitation, but was surface fogged, coated, exposed, and processed as described in Example 4A.

A reversal image was obtained exhibiting a maximum density of 5.6 and a minimum density of 0.9.

EXAMPLE 4D

Example 4C was repeated, except that the emulsion was reduction fogged at 40° C. with 2 mg dimethylaminoborane per silver mole.

A reversal image was obtained exhibiting a maximum density of greater than 5.7 with a minimum density of about 1.1.

EXAMPLE 4E

Control 4A was repeated, except that $1\times10^{-5}$ mole $K_2ReCl_6$ per silver mole was present in the reaction vessel at the beginning of precipitation.

One sample 4E(1) of the emulsion was reduction fogged identically as Control 4A. A second sample 4E(2) was reduction and gold fogged with 2.6 mg thiourea dioxide (30 min., 55° C.) and 4 mg anhydrous potassium tetrachloroaurate per silver mole (30 min., 55° C.) and Both samples produced a maximum density of greater than 3.8 and a minimum density of about 0.10 to 0.15.

EXAMPLE 4F

Control 4A was repeated, except that $1\times10^{-4}$ mole $K_2ReCl_6$ per final silver mole was present in the reaction vessel at the beginning of precipitation.

Two samples of the emulsion 4F(1) and 4F(2) were finished identically as emulsion samples 4E(1) and 4E(2). A third sample 4F(3) of the emulsion was sensitized with 10 mg tiourea dioxide (30 min., 55° C.) and 2 mg anhydrous potassium tetrachloroaurate per silver mole (30 min., 55° C.). The samples were exposed, coated, and processed identically as in Example 4E.

Sample 4F(1) and 4F(2) were faster than emulsion samples 4E(1) and 4E(2), but exhibited a lower maximum density. Sample 4F(3) also exhibited a higher speed than the 4E emulsion samples. Sample 4F(3) exhibited a maximum density of 5.7 and a minimum density of 0.08, but the minimum density increased to 0.2 at an exposure of 0.5 log E in excess of that required to reach minimum density. This indicated a tendency toward reversal on overexposure; however, it would not interfere with the photograpic response of coatings which were not overexposed.

EXAMPLE 4G

An emulsion like Emulsion 4B was prepared, except that the grain size was increased to 0.26 μm and the rhenium dopant concentration was adjusted to $1.7\times10^{-5}$ mole per final silver mole. The emulsion was reduction fogged with 10 mg of thiourea dioxide, 4 mg of anhydrous potassium tetrachloroaurate, and 50 mg of 5-methylbenzotriazole per silver mole. The emulsion was coated, exposed, and processed similarly as Emulsion 4B. The emulsion exhibited a maximum density of 5.6 and minimum density as low as 0.06, with some variation in minimum density being observed in different samples.

EXAMPLE 5

Cubic Silver Chloride Emulsions

This example illustrates the effectiveness of rhenium dopants in reducing the speed of a silver chloride photographic emulsion.

A series of monodispersed silver chloride cubic grain emulsion was precipitated in order to assess the photographic consequences of doping with hexahalorhenate $[ReX_6]^{-2}$ anionic complexes. The series having a cubic edge length of approximately 0.16 micrometer was prepared in the following manner:

The kettle solution was prepared with 74 grams of gelatin and 1.6 liters of distilled water; the pH was adjusted to 3.0 at 40° C. The temperature was raised to 49° C. and the pAg adjusted to 7.0. The emulsion was precipitated by the double jet addition of 3.ON silver nitrate and 3.3N potassium chloride while controlling the pAg at 7.0. A constant flow of 100 cc per minute of silver nitrate was maintained throughout. After 10% of the total silver nitrate had been added, the reagent addition was stopped, the temperature lowered to 35° C., and a chilled aqueous solution of dopant salt was added at a nominal concentration of 10 molar parts per final mole of silver. The mixture was stirred for an additional two minutes, after which the temperature was returned to 49° C. over a four minute period. The silver and salt flows were restarted and continued until a total of two moles of silver chloride was precipitated. The amount of incorporated dopant was determined by neutron activation analysis (see Table IV).

The emulsions were washed by the coagulation method of Yutzy and Russell U.S. Pat. No. 2,614,929, gold sensitized, coated on a cellulose acetate support, and photographically evaluated by a 20", 3000° K. exposure followed by development in a hydroquinone-Elon®(N-methyl=p-aminophenol hemisulufate) developer for 6 minutes. The photographic result is summarized in Table IV.

TABLE IV

| Summary for dopant incorporaiion and photographic data in AgCl cubes | | | |
|---|---|---|---|
| Grain size μm | Halide Ligand X | Re Level (1) micromoles per Ag mole | Speed (2) |
| 0.15 | none | 0.0 (3) | 100 |
| 0.18 | Cl | 9.5 | −43 |
| 0.16 | Br | 8.3 | −56 |

(1) Rhenium incorporaled in grains in micromoles per silver mole (μm/m) by neutron activation analysis; the level added to the emulsion during precipitation as 10 μm/m.
(2) Relative to the undoped control for a 20" 3000° K exposure; 100 speed units equals 1.0 log E.
(3) Detection Limit was <0.03 μmole/Ag mole.

EXAMPLE 6

Cubic Silver Bromide Emulsions

This example illustrates the effectiveness of rhenium dopants (added as $K_2ReX_6$, where X is halide) in reducing the speed and in improving the reciprocity characteristics of a silver bromide cubic grain emulsion.

A series of monodispersed silver bromide cubic grain emulsions having a cubic edge length of approximately 0.17 micrometer was prepared in the following manner:

The kettle solution was prepared with 40 grams of gelatin and 1.7 liters of distilled water; the pH was adjusted to 3.0 at 40° C. The temperature was raised to 75° C. and the pAg adjusted to 7.4. The emulsion was precipitated by the double jet addition of 4.5N silver nitrate and 3.9N potassium bromide while controlling the pAg at 7.4. A constant flow 17 cc per minute of silver nitrate was maintained throughout. After 10% of the total silver nitrate had been added, the reagent addition was stopped, the temperature lowered to 35° C., and a chilled aqueous solution of dopant salt was added at a nominal concentration of 10 molar parts per final mole of emulsion. The mixture was stirred for an additional two minutes after which the temperature was returned to 75° C. over a 6.5 minute period. The silver and salt flows were restarted and continued at a controlled pAg until a total of two moles of silver bromide were precipitated. The amount of incorporated dopant was determined by neutron activation analysis (see Table V).

The emulsions were washed by the coagulation method of Yutzy and Russell U.S. Pat. No. 2,614,929, sulfur and gold sensitized, coated on a cellulose acetate support, and photographically evaluated via 365 nm exposures followed by development in a hydroquinone-Elon® developer for 12 minutes. The photographic results are summarized in Table V.

TABLE V

| Summary of dopant incorporation and photographic data in AgBr cubes | | | | |
|---|---|---|---|---|
| Grain size μm | Halide Ligand X | Re Level (1) micromoles per Ag mole | Speed (2) | RF (3) |
| 0.17 | none | 0.0 (4) | 100 | −44 |
| 0.17 | Cl | 2.2 | −48 | — |
| 0.18 | Br | 6.0 | 80 | +16 |

(1) Rhenium in micromoles per silver mole (μm/m) by neutron activation analysis; the level added to the emulsion during precipitation was 10 μm/m.
(2) Relative to the undoped control for a 0.01" 365 nm exposure; 100 speed units equals 1.0 log E.
(3) Reciprocity failure as measured by the Log E difference between 100" and 0.01" 365 nm exposures.
(4) Detection Limit was <0.1 μmole/Ag mole.

EXAMPLE 7

Octahedral Silver Bromide Emulsions

This example illustrates the effectiveness of rhenium dopants (added as $K_2ReX_6$, where X is halide) in octahedral grain silver bromide emulsions.

A series of monodispersed silver bromide octahedral grain emulsions having an octahedral edge length of approximately 0.21 micrometer was prepared in the following manner:

The kettle solution was prepared with 20 grams of gelatin and 1.6 liters of distilled water; the pH was adjusted to 3.0 at 40° C. The temperature was raised to 75° C. and the pAg adjusted to 7.8. The emulsion was precipitated by the double jet addition of 4.ON silver nitrate and 4.ON potassium bromide while controlling the pAg at 7.8. After 10% of the total silver nitrate had been added at 8 cc per minute, the reagent addition was stopped, the temperature lowered to 35° C., the pAg adjusted to 9.8 with potassium bromide, and a chilled aqueous solution of dopant salt was added at a nominal concentration of 10 molar parts per final mole of emulsion. The mixture was stirred for an additional two minutes after which the temperature was returned to 75° C. over a 5.5 minute period. The silver and salt flows were restarted and accelerated to 48 cc per minute at the rate of 2 cc per minute while controlling at a pAg of 8.3 until a total of two moles of silver bromide was precipitated. The amount of incorporated dopant was determined by neutron activation analysis (see Table VI).

The emulsions were washed by the coagulation method of Yutzy and Russell U.S. Pat. No. 2,614,929, sulfur and gold sensitized, coated on a cellulose acetate support, and photographically evaluated via 365 nm exposures followed by development in a hydroquinone-Elon® developer for 12 minutes. The photographic results are summarized in Table VI.

TABLE VI

| Summary of dopant incorporation and photographic data in AgBr octahedra | | | | |
|---|---|---|---|---|
| Grain size μm | Halide Ligand X | Re Level (1) micromoles per Ag mole | Speed (2) | RF (3) |
| 0.22 | none | 0.0 (4) | 100 | −20 |
| 0.21 | Cl | 3.4 | −23 | — |

TABLE VI-continued

| Grain size μm | Summary of dopant incorporation and photographic data in AgBr octahedra: Halide Ligand X | Re Level (1) micromoles per Ag mole | Speed (2) | RF (3) |
|---|---|---|---|---|
| 0.2 | Br | 7.3 | 60 | +22 |

(1) Rhenium in micromoles per silver mole (μm/m) by neutron activation analysis; the level added to the emulsion during precipitation was 10 μm/m.
(2) Relative to the undoped control for a 0.01" 365 nm exposure; 100 speed units equals 1.0 log E.
(3) Reciprocity failure as measured by the Log E difference between 100" and 0.01" 365 nm exposures.
(4) Detection Limit was <0.01 μmole/Ag mole.

The invention has been described in detail with particular reference to preferred embodiments thereof, but it will be understood that variations and modifications can be effected within the spirit and scope of the invention.

What is claimed is:

1. A photographic silver halide emulsion comprised of radiation sensitive silver halide grains exhibiting a face centered cubic crystal lattice structure internally containing rhenium ions.

2. A photographic emulsion according to claim 1 in which the emulsion is a silver bromide or silver bromoiodide emulsion.

3. A photographic emulsion according to claim 1 in which the emulsion is a high chloride emulsion.

4. A photographic emulsion according to claim 1 in which rhenium is present in the emulsion in an amount sufficient to reduce photographic speed.

5. A photographic emulsion according to claim 1 in which a ligand differing from the halide forming the silver halide grains is incorporated in the grains along with rhenium ions.

6. A photographic emulsion according to claim 5 in which the incorporated ligand is a halide or aquo ligand.

7. A photographic emulsion according to claim 1 in which the rhenium ion is introduced into the emulsion in the form of a hexacoordination complex satisfying the formula:

$$[ReL_6]^k$$

where

L is chosen from halide and aquo ligands, with the proviso that no more than two of the ligands are aquo ligands k is the integer zero, −1, −2, −3, or −4.

8. A photographic emulsion according to claim 7 in which the silver halide grains are silver bromide or silver bromoiodide grains.

9. A photographic emulsion according to claim 8 in which the halide forming the ligands is chloride.

10. A photographic emulsion according to claim 9 in which rhenium ion is present in the grains in a concentration of from $10^{-8}$ to $10^{-7}$ mole per silver mole.

11. A photographic emulsion according to claim 8 in which the halide forming the ligands is bromide.

12. A photographic emulsion according to claim 11 in which rhenium ion is present in the grains in a concentration of from $10^{-7}$ to $10^{-5}$ mole per silver mole.

13. A photographic emulsion according to claim 1 in which the silver halide grains are surface fogged and the rhenium ions are present in a concentration sufficient to internally trap free electrons generated by photographic exposure.

14. A photographic emulsion according to claim 13 in which the rhenium ions are present in a concentration of from $10^{-3}$ to $10^{-8}$ mole per silver mole.

15. A photographic emulsion according to claim 14 in which the rhenium ions are present in a concentration of from $10^{-4}$ to $10^{-6}$ mole per silver mole.

16. A photographic emulsion according to claim 13 in which the silver halide grains are reduction and gold fogged at their surfaces.

* * * * *